United States Patent [19]

Bender

[11] 4,134,331

[45] Jan. 16, 1979

[54] CANOPY HOODS

[75] Inventor: Manfred Bender, Mississauga, Canada

[73] Assignee: Powlesland Engineering Limited, Rexdale, Canada

[21] Appl. No.: 801,570

[22] Filed: May 31, 1977

[51] Int. Cl.[2] ..... F23J 11/00

[52] U.S. Cl. ..... 98/115 LH; 98/42 R; 55/DIG. 18

[58] Field of Search ..... 98/115 R, 115 LH, 43, 98/42; 126/299 D, 300, 301; 55/DIG. 18, DIG. 36

[56] References Cited

U.S. PATENT DOCUMENTS

| | | | |
|---|---|---|---|
| 717,961 | 1/1903 | Anderson | 126/301 |
| 944,170 | 12/1909 | Bernstein | 126/299 D |
| 3,164,445 | 1/1965 | Hampel | 126/299 D |
| 3,364,664 | 1/1968 | Doane | 126/299 D |

*Primary Examiner*—Ronald C. Capossela

*Attorney, Agent, or Firm*—Sim & McBurney

[57] ABSTRACT

This invention relates to a fume hood in which side and top walls define a space enclosed on all sides but the underside, the hood having baffle plates within the space, the plates sloping upwardly and outwardly adjacent the side walls, the plates having their upper edges spaced from the walls of the hood. Suction opening is located in the top wall centrally above the baffle plates.

7 Claims, 9 Drawing Figures

CANOPY HOODS

This invention relates generally to canopy fume hoods for use in industrial applications, and has to do particularly with the design of a canopy fume hood particularly suited to fumes with irregular flow rates.

The problem of efficient capture of fumes in canopy fume hoods has recently become acute due to environmental protection legislation which has forced primary metals industries to install fume collection equipment on smelting furnaces. Previously fume collection systems have been relatively small, with suction capacities ranging from a few thousand to less than 100,000 CFM.

Large financial burdens are placed on the smelting industry when fume collection systems of up to one million CFM and over are contemplated.

In the primary metals industry, the charging operation in a medium capacity electric arc furnace generates a sudden surge of fume, which of course the collection system should be capable of containing. However, the previous fume collection systems have generally been sized to accommodate the regular fume flow during the operation of an electric arc furnace, and this has meant that the considerable extra surge produced during the charging operation has not been taken care of. In some installations, only about 50% of the fume generated during the charging operation of a medium capacity electric arc furnace can be collected.

In view of the foregoing difficulties encountered in the collection of fumes in canopy hoods, it is an aspect of this invention to provide a canopy fume hood design which is adapted to minimize the "spill-out" of fume when a fume surge is encountered, and which can reduce the cost of installation of a collection system which is intended to collect substantially all fume generated, including the extra surge upon the charging of an arc furnace.

Accordingly, this invention provides a fume hood which comprises:

an upper wall, a suction opening in said upper wall, fan means for withdrawing gas upwardly through said suction opening, side walls extending generally downwardly from edges of said upper wall, thereby to define with said upper wall a space enclosed on all sides but the under side, and baffle plates substantially within said space, said baffle plates sloping upwardly and outwardly with respect to the part of said space under said suction opening, the plates surrounding said part and at least some plates having their upper edges spaced from the walls defining said space, the plates defining between them a central passageway through which gas can pass to said suction opening.

Three embodiments of this invention are illustrated in the accompanying drawings, in which like numerals denote like parts throughout the several views, and in which.

Figure 2:
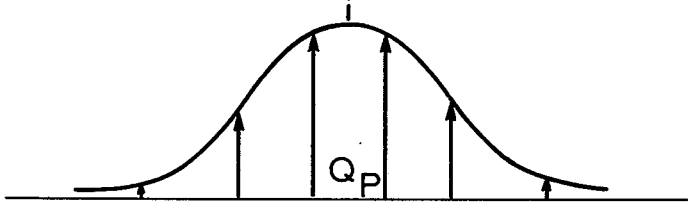
FIG. 2 is a velocity profile diagram for a typical fume rising from a fume-generating source.

In a general way, there is a "doughnut-shaped" circulation pattern existing around every upward hot air or gas flow emanating from a heated source. This circulation pattern is caused by the non-uniform velocity distribution within the plume, as can be seen in FIG. 2. The greatest vertical upward velocity exists in the centre, which is the hottest part of the plume, while the lowest velocity exists in the outer fringes of the plume where the plume merges with the surrounding still air.

Figure 1:
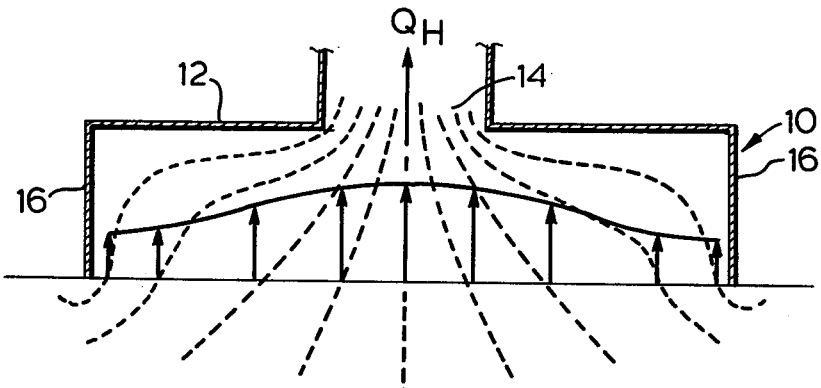
FIG. 1 PRIOR ART
FIG. 1 is a vertical sectional view through a conventional fume hood, representing the prior art, showing the velocity profile for gas flow into and through the hood.

FIG. 1 illustrates the velocity profile across a typical canopy fume hood 10 which represents the prior art. The hood 10 includes an upper wall 12, a suction opening 14 centrally of the upper wall 12, and side walls 16 extending generally downwardly from the edges of the upper wall 12, thereby to define with the upper wall 12 a space enclosed on all sides but the under side.

The velocity profile shown in FIG. 1 can be taken as that occurring when a suction means, such as a fan, is connected to the suction opening 14 to draw a particular flow rate of air through the opening 14, represented as $Q_H$. The condition of FIG. 1 would occur when no specific hot gas plume were being captured by the hood 10. In other words, the flow pattern shown in broken lines in FIG. 1 is merely that of the surrounding still air in the unheated condition, which is drawn through the hood 10 by virtue of the fan or other suction means.

If the hood 10 in FIG. 1 were now to be exposed to a particular plume of rising air or gas for which it had been specifically designed, the flow lines represented in broken lines in FIG. 1 would alter somewhat, but generally all of the rising plume would be taken into the hood 10 and expelled through the opening 14.

Figure 3:
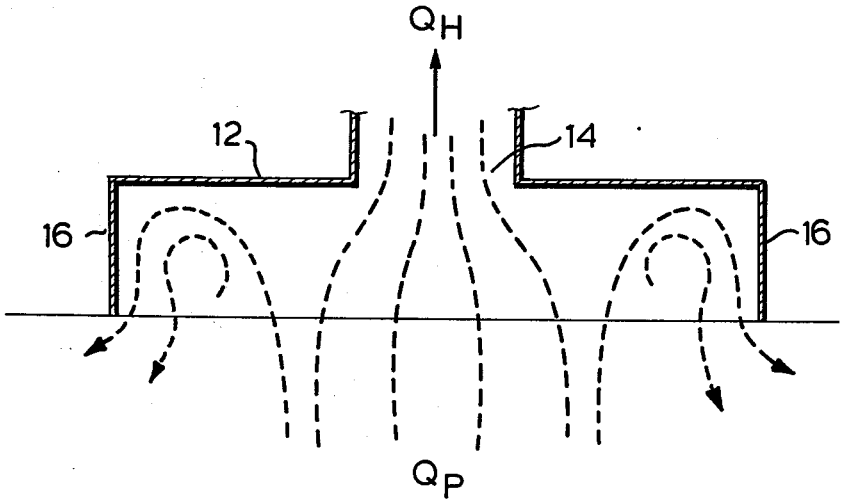
FIG. 3 PRIOR ART
FIG. 3 is a vertical sectional view through a conventional fume hood showing the circulation pattern of gas when a surge of fume enters the hood.

However, where the overall flow rate in the rising plume, designated as $Q_P$ in the Figures, is greater than the maximum evacuation capacity $Q_H$ of which the fan or other suction device is capable, the doughnut-shaped circulation pattern existing around the fringes of the plume would give rise to the pattern shown in broken lines in FIG. 3 of the drawings, in which a part of the total flow spills outwardly under the bottom of the side walls 16. In the situation shown in FIG. 3, only a fraction of the total plume flow $Q_P$ finds its way out through the suction opening 14.

In accordance with this invention, baffle means consisting of baffle plates are provided substantially within the space defined by the upper wall 12 and the depending side walls 16 of the hood 10. The baffle plates slope upwardly and outwardly and have their upper edges spaced from the walls defining the space.

Figure 4:
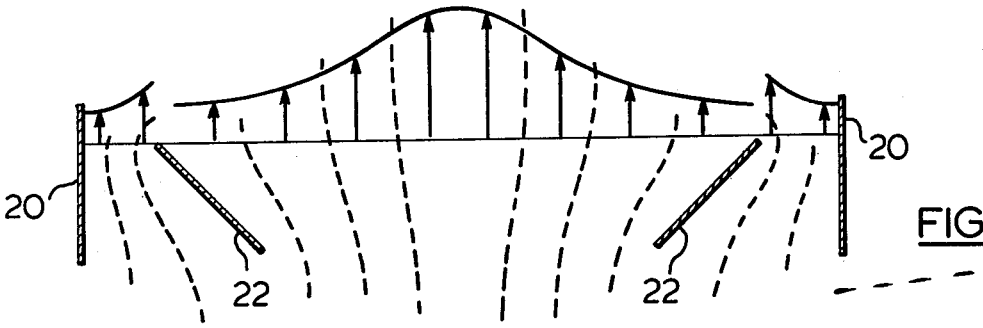
FIG. 4 is a somewhat diagrammatic representation showing velocity profiles around and between the baffle arrangement of this invention.

FIG. 4 is a diagrammatic illustration of the velocity profile imposed upon an upwardly flowing plume of hot air or other gas when the same passes between side walls 20 and around two obliquely sloping baffle plates 22. As is illustrated by the broken lines representing the flow contours, the outwardly diverging configuration of the baffle plates 22 causes the portion of the plume flowing upwardly between the plates 22 to expand and thus move more slowly, while the upwardly constricting space defined outwardly of the baffle plates 22 between the plates and the side walls 20 causes an increase in the velocity of the gases flowing in these locations. In the centre between the baffle plates 22 there remains a differential flow with the maximum flow rate still in the centre of the plume, but the flow profile has been evened out as compared to the flow depicted in FIG. 2, which represents the upwardly moving plume by itself.

The increase in the upward speed of the peripheral gases which pass outside of the baffle plates 22 serves to counteract the "doughnut-shaped" recirculation pattern which would normally be found at that location, and thus outward spillage of part of the flow underneath the lower edges of the side walls 20 is eliminated.

Figure 5:
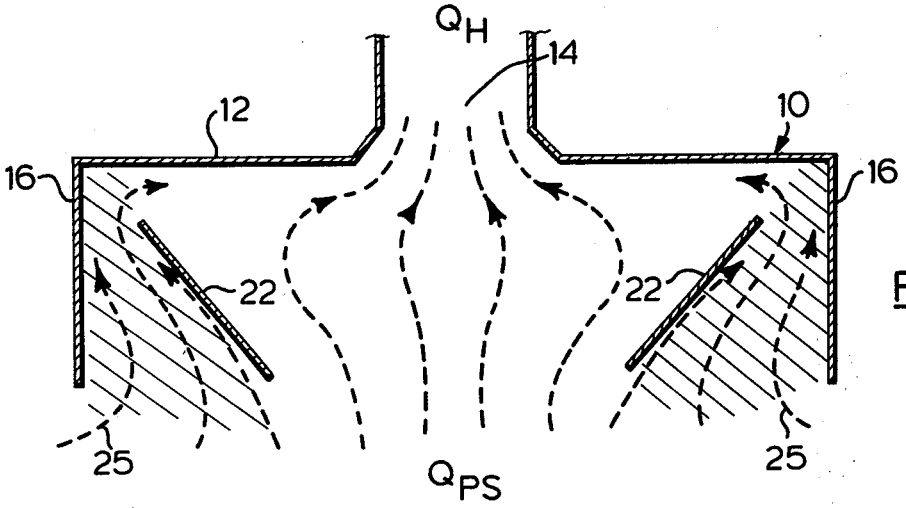
FIG. 5 is a vertical sectional view through the first embodiment of this invention.

Referring now to FIG. 5, it has been found that when the baffles 22 are located substantially as shown within a hood 10 similar to that depicted in FIG. 1, and when a standard or "design" plume flow rate $Q_P$ is allowed to move upwardly and centrally into the hood 10, most of the plume passes up the centre between the baffle plates 22 with only a minor, marginal portion passing outside of the baffle plates 22. This assumes that the suction flow rate $Q_H$ matches or is greater than the standard plume flow rate $Q_{PS}$. Under these circumstances, by far the greater proportion of the canopy space defined between the side walls 16 and the baffle plates 22 is not occupied by any of the hot gas from the plume, but rather is filled with ambient air as represented by the inflowing arrows 25 in FIG. 5.

Now, when the standard plume flow rate $Q_{PS}$ suddenly changes to a surge flow rate $Q_{sur}$, the additional flow over and above the normal capacity of the suction apparatus (operating at flow rate $Q_H$) will overflow outwardly into the spaces between the baffle plates 22 and the side walls 16 (hatched in FIG. 5), and will begin to displace outwardly the ambient air located in these spaces at the beginning of the surge. The excess flow will gradually fill up these spaces, and if the hood is adequately designed all of the excess gas in the surge will be accommodated in the spaces which are hatched in FIG. 5, and the flow will return to the normal flow $Q_{PS}$ before any of the excess gas begins to spill or leak outwardly under the bottom edges of the side walls 16.

When the surge has passed and been taken up through the suction opening 14, the flow would return to normal with surrounding ambient air again entering the hatched spaces between the baffle plates 22 and the side walls 16.

It has been found generally that an angular disposition of the baffle plates 22 at about 45° with respect to the side walls 16 provides satisfactory performance of the modified collecting hood of this invention. Some departure from this angle is contemplated within the scope of this invention.

Figure 6:
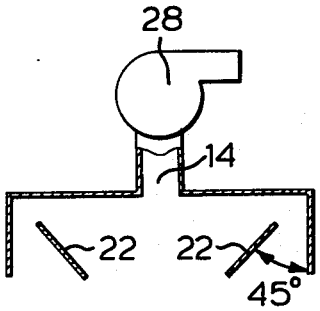
FIGS. 6, 7 and 8 are vertical sectional views through the first, second and third embodiments of this invention, respectively.

In FIG. 6, the first embodiment of this invention is again shown, with a fan 28 being illustrated above the suction opening 14.

Figure 7:
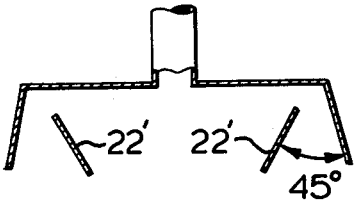

In FIG. 7, the second embodiment of this invention is illustrated, in which the depending side walls of the hood extends downwardly and somewhat outwardly, at an angle to the vertical. Again, the baffle plates 22' would be disposed at an angle of roughly 45° with respect to these sloping side walls.

Figure 8:
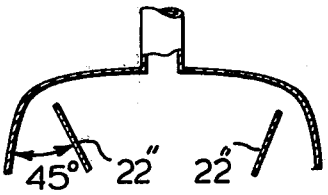

FIG. 8 shows a third embodiment of this invention, in which the hood space is defined by curved surfaces, but in which the baffle plates 22" are nonetheless disposed at about 45° to the main direction of what can be considered the equivalent of the side walls of the hoods in FIG. 6 and FIG. 7.

An advantage of the construction just described relates to the tendency for particles in the plume to settle out on any surface associated with the hood which may be horizontally disposed or substantially so. There are some prior art installations in which flat, horizontal bands or strips are placed across the mouth of a canopy hood in order to restrict flow. Such surfaces, however, would naturally constitute resting places for particulate material in the plume. In the present construction, the baffle plates are disposed at a substantial angle to the horizontal, and under normal circumstances would not be capable of collecting significant amounts of particulate material from the plume.

In certain installations, the suction opening would not be located centrally of the canopy hood. For example, the suction opening could be adjacent a wall, with the fume-generating source being also directly under the wall. The canopy could in such circumstances be built out from and supported by the wall, with the suction opening displaced from the geometric centre of the canopy area, as seen in plan view. In such a circumstance, it could be appropriate to provide angulated baffle plates along three sides of the rectangle, i.e., only along the three downwardly depending side walls of the canopy hood, it being understood that the wall of the building constitutes the fourth "side". In other words, there would be no baffle plate provided adjacent the wall of the building, but only on the other three sides of the rectangle.

Figure 9:
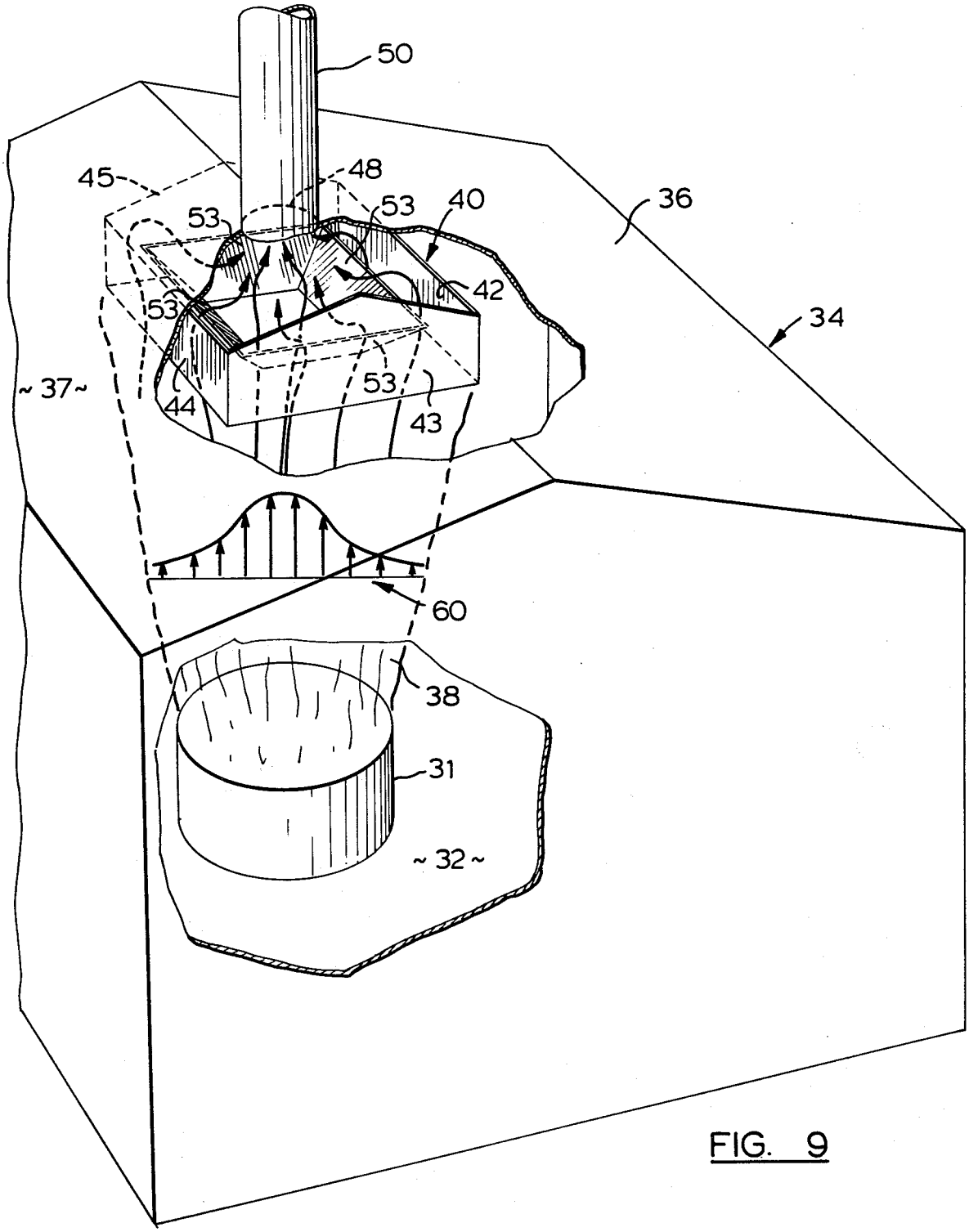
FIG. 9 is a perspective view of an installation using the first embodiment of this invention.

An example of this kind of application is illustrated in FIG. 9, in which a fume-emitting hot process is illustrated diagrammatically at 31 on the floor 32 of a building 34. Some of the building walls have been removed for clarity of illustration. Two roof panels 36 and 37 are located above the fume-emitting process 31. As can be seen, the fume 38 gradually increases in cross section as it rises, due to the entrainment of surrounding ambient air. This entrainment dilutes the fume and lowers its average temperature, but at the same time it increases the volume which must be taken off by the canopy hood. Suspended under the roof panel 36 is a canopy hood shown generally at 40, seen to consist of four vertically downwardly depending side walls 42, 43, 44 and 45. The roof panel 36 itself constitutes the upper wall of the canopy, and it contains a suction opening 48 which is connected to a conduit 50 leading to a suction device such as a fan (not shown).

Mounted within the space defined by the side walls 42-45 and the roof panel 36 are four downwardly and inwardly converging baffle plates 53, which are disposed at substantially 45° to the side walls 42-45. The baffle plates have their upper outer edges spaced both from the corresponding side wall and from the roof panel 36, so that fume entrained to the outside of the baffle plates 53 can pass around the upper edge of the baffle plate and enter the suction opening 48.

The velocity profile of the plume is shown at 60 in FIG. 9.

It is to be understood that the number of baffle plates to be utilized in an installation in accordance with this invention is extremely variable. In certain cases, due to cross currents and so forth in the space in which the fume-generating process is located may give rise to a tendency for fume to spill out of a canopy hood only on one or two sides, but not on the other sides. In this kind of circumstance, it may be sufficient to provide baffle plates only adjacent the sides where the spillage tends to occur.

A further advantage of the construction according to this invention becomes clear when considering what is called the "entrainment height" of a given fume hood. Generally speaking, the entrainment height for a given plume rising to be accommodated in a given canopy fume hood is the height at which the marginal edges of the plume actually contact a portion of the fume hood.

In a substantially rectangular canopy hood, if the same has been constructed large enough to extend beyond the normal position of the marginal edges of the rising plume, these marginal edges do not come into contact with the hood until they reach the upper or top wall of the hood. This consideration effectively increases the minimum capacity of the fume hood which is required to handle the plume, because the total volume of the rising plume is constantly increasing, as can be seen in FIG. 9. Theoretical considerations (confirmed by empirical studies) indicates that the suction volume required to handle a given plume increases as the 5/3 power of the height between the source of the plume and the location of first contact between the plume and the collection device. In effect, the insertion of baffles in accordance with this invention lowers the effective height between the fume-generating device and the "first contact" with the canopy hood to the location of the lower edges of the canopy hood, rather than the upper wall as is usually the case. Where the height of the canopy hood is in the region of 20 to 30% of the total distance between the fume-generating process and the hood, the minimum capacity for the hood could be almost doubled due to the effect of the 5/3 power. The reason why the baffles bring the effective height down to the lower limit of the canopy rather than the top has to do with the fact that the baffles constitute a wall preventing entrainment of ambient air with the plume beyond their lower edges. In effect, they constitute a partition which prevents further mixing above their lower edges.

I claim:

1. A fume hood which comprises:
an upper wall,
a suction opening in said upper wall,
fan means for withdrawing gas upwardly through said suction opening,
side walls extending generally downwardly from edges of said upper wall, thereby to define with said upper wall a space enclosed on all sides but the under side,
and baffle plates substantially within said space, said baffle plates sloping upwardly and outwardly with respect to the part of said space under said suction opening, the plates surrounding said part and at least some plates having their upper edges spaced from the walls defining said space, the plates defining between them a central passageway through which gas can pass to said suction opening.

2. The fume hood claimed in claim 1, in which the baffle plates are planar and are provided inwardly adjacent said side walls.

3. The fume hood claimed in claim 2 in which the baffle plates are edge-joined and are sloped at substantially 45°.

4. The fume hood claimed in claim 3, in which the side walls are substantially perpendicular and extend down at least sufficiently to be horizontally even with the bottom of the baffle plates.

5. The fume hood claimed in claim 1, in which said suction opening is substantially centrally located in said upper wall.

6. The fume hood claimed in claim 4, in which the upper wall is rectangular and in which the suction opening is substantially centrally located in said upper wall.

7. A fume hood which comprises:
an upper wall,
a suction opening in said upper wall,
fan means for withdrawing gas upwardly through said suction opening,
side walls extending generally downwardly from edges of said upper wall, thereby to define with said upper wall a space enclosed on all sides but the under side,
and baffle means in said space, said baffle means dividing the space into a) an inner region of which the horizontal cross-sectional area increases upwardly and b) a marginal region outside said inner region, the horizontal cross-sectional areas of said marginal region decreasing upwardly, the inner and the marginal region being in communication above the baffle means, said inner region providing a central passageway through which gas can pass to said suction opening.

* * * * *